United States Patent [19]

Hammond

[11] 4,292,785

[45] Oct. 6, 1981

[54] TILE PACKAGING

[75] Inventor: Leslie G. Hammond, Leighton Buzzar, England

[73] Assignee: Anchor Building Products Limited, England

[21] Appl. No.: 75,283

[22] Filed: Sep. 12, 1979

[30] Foreign Application Priority Data

Sep. 20, 1978 [GB] United Kingdom ..... 37540/78

[51] Int. Cl.[3] ..... B65B 13/18

[52] U.S. Cl. ..... 53/399; 53/542; 53/582; 53/589; 100/25

[58] Field of Search ..... 53/399, 542, 582, 587, 53/588, 589; 100/25, 26

[56] References Cited

U.S. PATENT DOCUMENTS

| | | | |
|---|---|---|---|
| 1,522,194 | 1/1925 | Labombarde | 53/589 X |
| 1,857,082 | 5/1932 | Hall | 53/542 X |
| 2,743,562 | 5/1956 | Dawson | 53/588 X |
| 3,379,121 | 4/1968 | Lems | 53/589 X |
| 3,438,521 | 4/1969 | Munck | 53/399 X |
| 3,533,351 | 10/1970 | Lehmann | 100/26 X |
| 3,808,772 | 5/1974 | Tortschan | 53/559 |
| 3,955,340 | 5/1976 | Tomita | 53/587 |
| 4,137,788 | 2/1979 | Fischer | 53/589 X |
| 4,176,993 | 12/1979 | Lunginbuhl | 53/542 X |
| 4,178,739 | 12/1979 | DuBrof | 53/210 |

*Primary Examiner*—John Sipos

*Attorney, Agent, or Firm*—Biebel, French & Nauman

[57] ABSTRACT

A method of and apparatus for packaging a stack of tiles of which the tiles are supported on one edge thereof, in which the stack is supported at its base from one side only of the longitudinal central line of the stack and at another location of the stack, whereby to permit wrapping and securing a strap around that section of the stack which is unsupported at its base to form a tile package.

13 Claims, 4 Drawing Figures

TILE PACKAGING

BACKGROUND OF THE INVENTION (1) Field of the invention

This invention relates to a method of and apparatus for strapping a plurality of individual tiles together to form a package. More particularly, the invention is concerned with the packaging of extruded concrete roofing tiles.

In extrusion processes for manufacturing concrete roofing tiles, the tiles are continuously extruded on pallets and are fed on a conveyor system incorporating belt conveyors from the tile extrusion machine to a depalleting device, usually via a curing zone in which the tiles are partially cured. After depalleting, the tiles are removed from the conveyor and stacked in the open air for curing or to complete the curing process as the case may be.

In order to avoid manual handling of large numbers of uncured or partially cured individual tiles, involving at least one operative with the attendant possibility of the tiles being damaged during removal from the conveyor line, stacking in the open air and transport to site, various systems have been devised for arranging the tiles in successive stacks comprising, for example 40 tiles, and securing a strap or band around each stack of tiles to form a package. By this means the number of individual units which have to be dealt with is considerably reduced, the tile packages can be handled by machines and the risk of breakage is largely eliminated.

In strapping stacks of concrete roofing tiles it is desirable, if not essential, that the strap be secured around the ends of tiles in the central longitudinal region of the stack in order to avoid damage and possible breakage to the interlocks extending along opposite sides of the tiles, during tensioning and securing of the strap. Power strapping machines are known for strapping cartons and have also been used for packaging tiles. One such strapping machine comprises a rectangular chute frame formed of inwardly opening channel sections in which a strap of plastics material is fed from a reel, the carton being fed into the space within the frame under the control of an operator so that the strap encircles the carton. The machine is then operated whereby the machine wraps the strap around the carton, tensions and secures the strap as by heat or friction welding, crimping or clipping.

(2) Description of the prior art

Such a power strapping machine is used in one packaging system known to the Applicants for strapping clay roofing tiles formed on a belt conveyor into a horizontal stack in which the tiles are disposed upright one behind the other on one of their edges and are held by hydraulic clamping devices in the stack to maintain the tiles upright. Since, a strapping machine having a rectangular chute frame cannot be used to strap the horizontal stack of tiles whilst on the belt conveyor, the stack is removed by means of the clamping devices to a roller conveyor adjacent the belt conveyor where the chute frame is positioned between adjacent rollers and the stack whilst remaining clamped is fed into the chute frame for strapping.

Also known to the Applicants is a system for packaging extruded concrete roofing tiles which involves the forming of a horizontal stack of tiles on a belt conveyor and clamping of the stack to maintain the tiles in an upright position. In this system, the conveyor is stopped at a strapping location where an open bottomed chute frame mounted on a moving trolley is positioned over the clamped stack of tiles. Then a bayonet carrying one end of the strap extending around the chute frame is fed through a channel disposed between two runs of the belt conveyor and the strap is then wrapped around the stack. Stopping of the conveyor for the strapping operation is disadvantageous since the stacking and strapping operation has to be synchronized precisely to the speed of the extrusion machine which may operate at speeds upwards of 4000 tiles per hour. Moreover, bayonet feed of the strap can give rise to problems.

Two other known systems involve the use of turntables on which extruded concrete roofing tiles fed from a belt conveyor system are stacked flat one on top of the other. The turntable is then turned to bring the vertical stack of tiles to a station at which is located a stationary strapping machine. Since the tiles are stacked on the turntable, the chute frame of the strapping machine has to be at least partially open at the bottom and the strap must be fed by hand across the opening before the machine can wrap the strap around the tile stack. In these systems, the stack is supported on a slotted base on the turntable so that the strap can be wrapped around the stack. After strapping, the turntable is turned to another station where the tile package is clamped, rotated into a horizontal position and placed on another conveyor system.

All the above systems involve the use of complicated and expensive apparatus, and sophisticated electrical control systems for synchronizing the stacking and strapping operations to the speed of the conveyor systems used and in the cases of extruded concrete roofing tiles to the speed of the extrusion machine. In the systems using turntables, stacking of partially cured or uncured tiles flat one on top of the other leads more easily to tile damage. Moreover, the apparatus have large numbers of moving parts which can be expensive to maintain and which can more easily breakdown in the dusty environment of a tile making factory.

Accordingly, it is an object of the present invention to minimize or overcome the aforementioned disadvantages by providing a system for packaging tiles in which the apparatus has fewer moving parts, is simpler and less expensive than the aforementioned apparatus, which can strap stacks of tiles on a belt, band or chain conveyor without stopping the conveyor and which can utilize a strapping machine having a rectangular chute frame.

SUMMARY OF THE INVENTION

To this end, and from one aspect, the present invention consists in a method of packaging tiles, in which the tiles are stacked one behind the other on one edge thereof, characterized by supporting the stack of tiles at the base of the stack from one side only of the longitudinal central line of the stack and from another location of the stack and by wrapping and then securing a strap around that section of the stack which is unsupported at its base.

By supporting a stack of roofing tiles at its base from one side only of the longitudinal central line of the stack, a strapping machine having a rectangular chute frame can be employed by moving the frame into and out of a position in which it encircles that section of the stack which is unsupported at its base, between the interlocks, whilst the stack moves along the conveyor line. Thus the stacking and strapping operations can be easily synchronized to the speed of the tile extrusion machine with a minimum of electrical control equipment resulting in a truly continuous operation from extrusion to packaging.

From another aspect, the system according to the present invention consists in apparatus for strapping a stack of tiles arranged one behind the other on one edge thereof, characterized in that the apparatus comprises means for supporting the stack of tiles at its base from one side only of the longitudinal central line of the stack, means for supporting the stack at another location thereof, and means for wrapping and securing a strap around that section of the stack which is unsupported at its base.

Advantageously, the means for supporting the stack of tiles from one side only of the longitudinal central line of the stack comprises a narrow belt, band or chain conveyor which engages the bottom edge of the stack of tiles, and the means for supporting the tile stack at another location may be positioned either to engage the upper edge of the stack opposite the means for supporting the stack at its base or alternatively engage that side edge of the stack which is further from the supported base section of the stack. Such support means are synchronized to move at the same speed as the narrow belt, band or chain conveyor. Conveniently the narrow belt, band or chain conveyor is constituted by one run of the existing conveyor on which the tiles are stacked and which conveys the stack of tiles to the strapping location.

In a preferred embodiment of the invention, the means which engages the said side edge of the stack comprises a movable support carrying means which engage with this side edge, the support being moved at a speed which is synchronized with that of the conveyor. The movement of the support and conveyor moves the package of tiles out of the strapping station and onto a belt conveyor which supports the stack across the bottom edges of the tiles.

In those prior art systems referred to previously, in which the tiles are stacked one behind the other, expensive clamping arrangements have to be used in order to maintain the stack vertical. However, such clamping arrangements are avoided in accordance with another aspect of the present invention, which consists in a method of feeding tiles to a strapping station, characterized by turning the tiles from a position in which they lie on one face thereof into a position in which the tiles are stood up and stacked one behind the other on one edge thereof and in that the tiles are supported with adjacent tiles in contact with each other in a sloped position just off the the vertical and are fed in this condition to the strapping station.

A further aspect of the invention consists in apparatus for standing up the tiles into said position and for feeding said tiles in said position to said strapping station.

In order to maintain the tiles in the sloped position, there is advantageously provided a continuous belt, band or chain disposed to one side of an extending along the stacking and strapping stations and which are projecting therefrom into a position above the conveyor a plurality of support members against which the leading tile of the stack can lean to support the remaining tiles of the stack.

In a preferred embodiment of the invention, the apparatus comprises switching means in the path of travel of the tile stack to be actuated by the stack when in position for strapping to initiate movement of the chute frame of the strapping machine into a strapping position in which the frame encircles the section of the stack which is unsupported at its base and wraps and secures the strap around the tiles of the stack to form a package of said tiles. Immediately after strapping, the frame is moved back to its initial position so as not to impede advance of the tile package out of the strapping station.

The entire strapping machine may be mounted on a pivotable arm or on a support either of which is operated for example by a double acting piston and cylinder device actuated by the switching means to pivot or linearly move the machine into and out of the position in which the strapping frame encircles the section of the stack which is unsupported at its base.

The strap is conveniently of plastics material such as "Nylon" for example but may be of any suitable flexible material e.g. of metal.

DESCRIPTION OF THE PREFERRED EMBODIMENT

Figure 1:
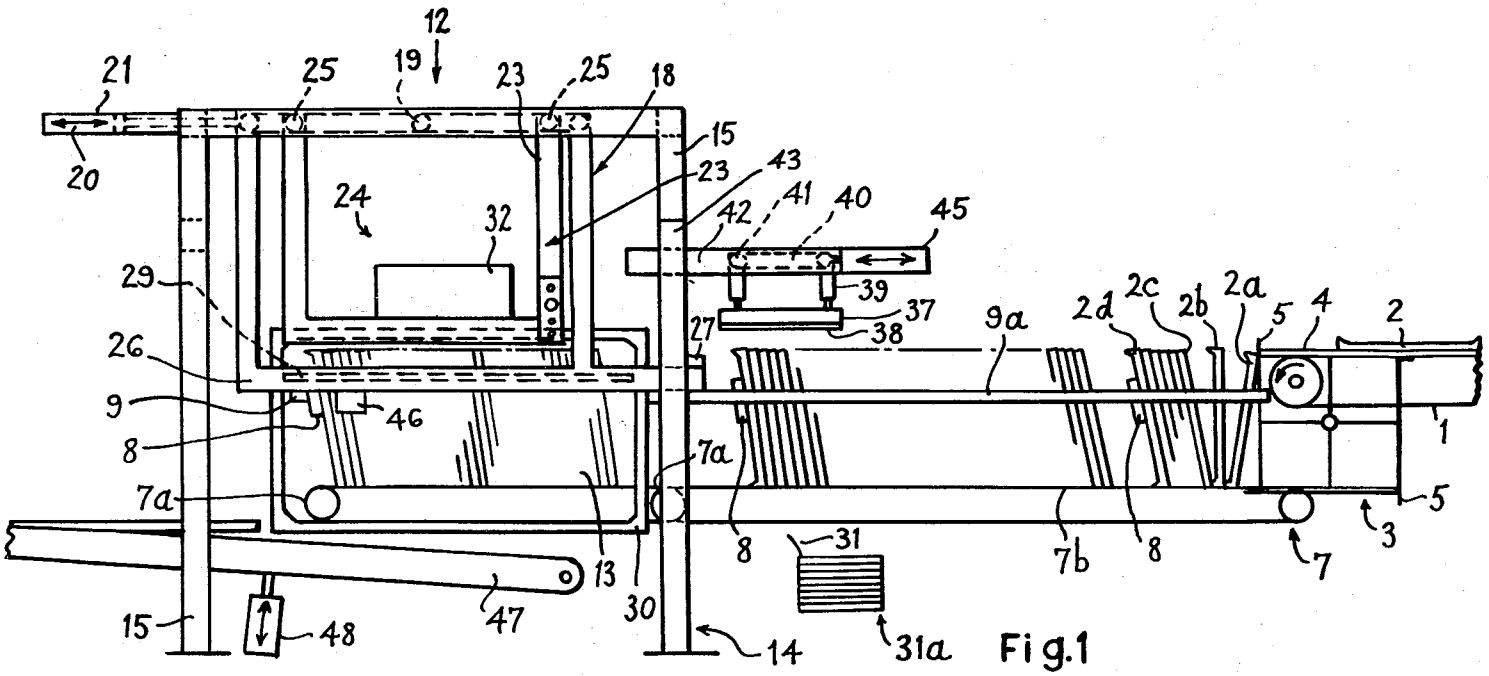
FIG. 1 is a side elevation of an apparatus for stacking and packaging extruded concrete roofing tiles, showing a stack of tiles in position for packaging.

Referring to the drawings, there is shown a conveyor 1 which feeds uncured or partly cured tiles 2 from a depalleting device (not shown) to a stacking device generally indicated at 3. The stacking device 3 comprises a rotatable member 4 for successively standing-up tiles 2 into a generally upright position and having four sides each of which terminates in a respective ridge 5 with which the leading edge of a tile 2 is brought into engagement by the movement of the conveyor 1.

As the leading edge of each successive tile 2 engages a ridge 5, the stand-up member 4 is turned through an angle of 90° by means of an electric motor (not shown) which drives the shaft 6 on which the stand-up member is mounted, to bring the tile into the position occupied by the tile 2*a*. In this position the tile 2*a* is supported along its bottom edge on a belt or band conveyor 7 having two runs or bands 7*a*, 7*b* and its upper edge rests against the stand-up member 4. Further rotation of the stand-up member 4 to stand-up the next tile 2 will cause the tile 2*a* to move through the vertical position occupied by the tile 2*b* and into the sloped position as occupied by the tile 2*c* which rests against the next adjacent sloping tile. The first tile 2*d* of the sloping stack leans against two support members 8 projecting over the conveyor 7 into the path of travel of the sloping stack and carried by respective endless chains 9, 9*a*, thus the support members 8 support the entire sloping stack of tiles through the tile 2*d*. The stack has a top surface, a base surface and four side surfaces which surfaces may also be referred to hereinafter as top, base and side edges of the stack, respectively. The chains 9 are driven in synchronism with the conveyor 7 by means of a suitable electric motor (not shown) through respective pairs of sprockets 10 which are rotatably mounted on suitable supports 11 standing on the ground or secured to the side frame of the conveyor 7. So that the tiles can be stacked whilst a preceding tile stack is strapped in a manner to be described, the chains 9, 9*a* also carry further support members 8 at appropriately spaced intervals to permit each stack to comprise for example 40 tiles. The sloping stack of tiles is then fed into a strapping station, generally indicated by the reference 12 in FIG. 1, in which the narrow run 7*b* of the conveyor 7 is omitted so that the bottom edges of the tiles of the stack 13 in the strapping station only engage the narrow run 7*a* of the conveyor and the stack 13 of tiles is thus supported at its base from one side only of the longitudinal central line of the stack.

The strapping device comprises a main frame 14 having two pairs of vertical uprights 15 fixed to the ground on opposite sides of the strapping station 12 and joined together at their upper ends by channel section frame members 16 extending parallel to the conveyor run 7*a* and end frame members 17 extending transversely of the conveyor run 7*a*.

A support frame 18 is suspended from the frame members 16 by wheels 19 which run in the channels therein and is reciprocable along the path of movement of the tile stack 13 in the directions of the arrows 20 in synchronism with the movement of the tile stack on conveyor run 7*a* by means of a fluid-pressure operated double-acting piston and cylinder device 21 mounted on the downstream cross-member 17 of the main frame 14. The support frame 18 has upper cross-frame members 22 of channel-shaped cross-section from which a further support frame 23 for a power strapping machine; generally indicated at 24, is suspended by means of wheels 25 which run in the channels of the frame members 22. The lower frame member 26 of the support frame 18 extends upstream beyond the cross-members 17 of the main frame 14, where the frame member carries a freely-rotatable lead-in wheel 27 which engages the side edge 28 of the tile stack 13*a* as it is moved into the strapping station. The lower frame member 26 also carries a band 29 which is freely rotatable on rollers and extends along the path of movement of the tile stack 13. The band 29 is engaged by the side edge 28 of the tile stack 13 at a location nearer its upper edge thereby to maintain the tile stack balanced on the conveyor run 7*a*. Thus the tile stack is supported at two locations.

The power strapping machine 24 is basically of a conventional type which is well known and is manufactured by Signode Limited under their Model Nos. MCD700 or MCD300. This strapping machine comprises a rectangular chute frame 30 comprising inwardly opening channel shaped sections forming a path around which a length 31 of plastics material is fed from a reel 31*a* by a mechanism generally indicated at 32. When an object, in this case a stack of tiles, is disposed within the space of the rectangular frame 30, with the strap in position within the channel sections of the frame, the control mechanism of the machine can be actuated such that the strap is pulled out of the channel sections, wrapped around the stack of tiles, tensioned and then secured whilst maintaining the tension by rubbing the strap ends together to produce a friction weld.

Figure 3:
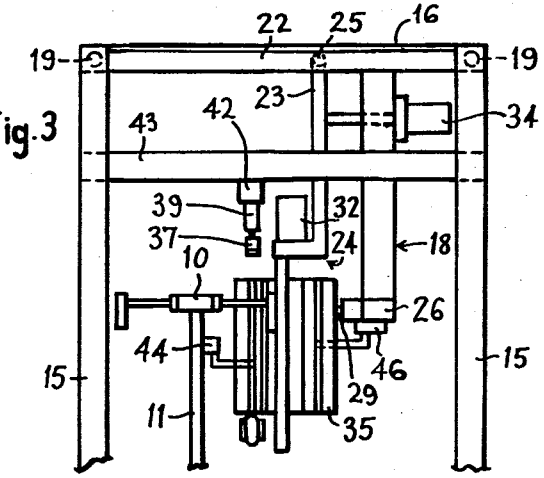
FIG. 3 is an end view of a part of the apparatus of FIG. 1 showing a strapping device in position for passing a strap around the stack of tiles.
Figure 2:
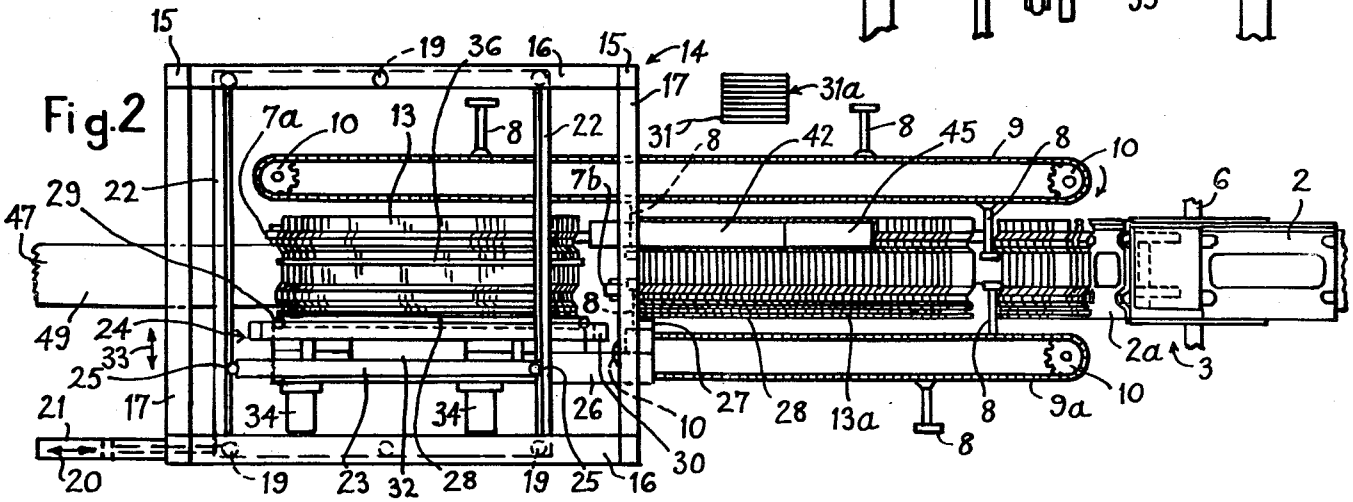
FIG. 2 is a plan view of the apparatus of FIG. 1, showing a strap around a stack of the tiles.

In the apparatus illustrated in the drawing, the strapping machine is mounted on the frame 23 with the chute frame 30 depending downwardly therefrom and the frame 23 is moved linearly with respect to the support frame 18 in the directions of arrows 33 from the position shown in FIG. 1 to the position shown in FIG. 3, where the chute frame encircles the stack of tiles in the strapping station 12, by fluid-pressure operated double-acting piston and cylinder devices 34 acting between the two frames 18 and 23. It will be appreciated that the length of the band 29 is such that it always lies within the confines of the chute frame 30 so that the movement of the frame 30 is not impeded. Therefore, the chute frame can be moved to encircle a section 35 of the tile stack 13 which is unsupported at its base to wrap and secure a strap 36 around this section at or near the longitudinal central line of the stack and inwardly of the tile interlocks as shown in FIG. 2.

In order to ensure that the individual sloping tiles of the stack 13*a* do not tip backwards as the stack is moved from the support of the two conveyor runs 7*a* and 7*b* and into the strapping station 12, an elongate support element 37 is brought into engagement with the upper edge of the stack and is moved with it. The element 37 carries a resilient pad 38 of rubber or plastics material for engaging the upper edges of the tiles and is moved into and out of contact with the stack at a location above and opposite the conveyor run 7*a* by a pair of pressure-fluid operated double-acting piston and cylinder devices 39. The devices 39 are mounted on a rod 40 carrying wheels 41 which run in the channel of a support beam 42 fixed to a cross-frame member 43 of the main frame 14. The beam 42 projects upstream of the path of movement of the tiles beyond the main frame 14 and also slightly downstream of the main frame. When a lever operated microswitch 44 mounted on the support 11 is operated by the tile stack, the piston and cylinder devices are actuated to move the element 37 downwards so that the pad 38 engages the upper edges of the tiles towards the rear end of the stack 13. Simultaneously, the element is moved towards the strapping station 12 by a fluid-pressure operated piston and cylinder device 45 acting on the rod 40. When the stack 13 is in the position for a strapping operation, the piston and cylinder devices 39 are retracted and the piston and cylinder device 45 moves the element 37 in the upstream direction back to its original position.

A lever-operated switch 46 is mounted on the lower frame member 26 of the support frame 18 so that its lever projects into the path of movement of tile stack 13 on the conveyor run 7*a* and is also connected to an electrical drive motor (not shown) for a belt delivery conveyor 47 projecting beneath the stacking station 12. The delivery conveyor 47 is mounted to be pivoted from its inclined position illustrated in FIG. 1 to a substantially horizontal position in which it receives the strapped stack 13 of tiles, by a pressure fluid operated double-acting piston and cylinder device 48. The conveyor 47 is only partly shown and has a wide belt 49 which supports the stack 13 across its base, and moves the stack to a location out of the picture where it can be removed, e.g. by suitable clamping devices onto a pallet for removal to a location in the open air by a fork-lift truck for example. The switch 46 is connected into the control circuitry of the strapping machine so that, when actuated, initiates the operation of wrapping and securing the strap around the stack of tiles, after which the frame 30 is retracted by the devices 34 to bring the chute frame 30 out of the path of stack movement. The switch 46 is also connected to the piston and cylinder device 45 so that the element 37 is moved back to its initial position and the devices 39 are retracted to move out of the path of movement of chute frame 30, and the switch 46 is connected to the device 48 to move the conveyor 47 upwards and into its delivery position. Whilst the tile package 13 is being moved out of the strapping station, the support frame 18 is moved back to its initial position by the device 21 and a further stack of sloped tiles is fed into the strapping station for strapping. After delivery and before the chute frame 30 is brought into the strapping position the conveyor 47 is moved back to its initial position shown in FIG. 1. The movement of the conveyor 7 with its runs *7a, 7b,* as well as that of the support frame 18 is conveniently a step-wise motion which is synchronized with the movement of the stand-up device 3 which in turn is synchronized with the movement of the belt conveyor 1. FIG. 2 shows the strapped tile stack 13 already moving out of the strapping station 12 and the tile stack 13*a* beginning to enter the strapping station.

Figure 4:
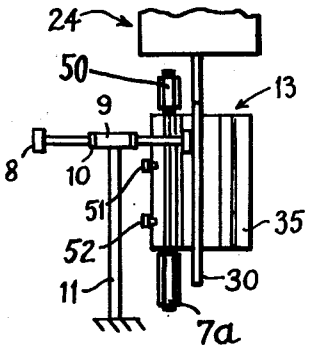
FIG. 4 is an end view, similar to that of FIG. 3, of a modification.

In the modification shown in FIG. 4, the band 29 may be replaced by a conveyor band 50 mounted above and engaging the upper edge of the tile stack, the conveyor band running lengthwise of the conveyor stack at the strapping location and being driven in synchronizm with the movement of the conveyor 7. A lever operated microswitch 51 projects into the path of movement of the sloping tile stack 13 to be actuated by the stack when it is in a position for strapping to stop the upper conveyor 50 and bring the chute frame 30 to the strapping position whilst the movement of the conveyor run *7a* continues to bring the individual tiles of the stack into a substantially vertical position whereupon a second lever operated microswitch 52 is operated to start the conveyor 50 and initiate the strapping operation. In this modification the movement of the conveyor run *7a* is continuous and not step-wise.

Various modifications may be made without departing from the scope of the invention. For example, the stand-up member may be constructed to receive more than one tile 2, e.g. four and stack more than one tile at a time. Instead of being mounted as described, the strapping machine may be mounted on a pivoting arm which is pivotable into and out of the strapping position. The switches 44 and 46 may be replaced by appropriate mechanical means and suitable operating linkage, motors or electrical solenoids may replace the various piston and cylinder devices. The element 37 and its actuating devices may be omitted.

The tile stack 13 may be strapped with the tiles in a substantially vertical position in which case the microswitch 46 can be arranged to operate as the microswitch 51 of FIG. 4 to stop the movement of the support frame 18 and bring the chute frame 30 into the strapping position and a further microswitch like the microswitch 52 of FIG. 4 be operated to re-start the movement of the support frame 18 and initiate the strapping operation. The movement of the conveyor run *7a* may be continuous or step-wise.

In another modification, the band 29 may be omitted and replaced by a reciprocatory member such as the element 37 arranged above the tile stack opposite the conveyor run *7a* to engage the upper edge of the stack 13 and so that the strapping frame may encircle the tile stack at the strapping station, the movement of this element 37 being synchronized with that of the conveyor 7.

Although the invention has been particularly described with reference to extruded concrete roofing tiles it should be appreciated that the invention is also applicable to clay roofing tiles and concrete and clay cladding tiles.

I claim:

1. A method of packaging tiles, each having projections on at least one face thereof, said method comprising positioning said tiles one behind the other on one edge thereof to form an elongate stack having a top surface, a base surface and four side surfaces with opposite ends of said stack being formed by faces of the end tiles of the stack, conveying said stack of tiles in the direction of the longitudinal central line of the stack through a packaging station having inlet and outlet ends, supporting the stack of tiles, whilst being conveyed through the packaging station, along the base surface of the stack on one side only of the longitudinal central line of the stack leaving the base surface of the stack, on the opposite side of the longitudinal central line of the stack, unsupported and along another surface of the stack, thereby to maintain the integrity of the stack without interfering with the packaging operation, and, during the passage of the stack through the packaging station, wrapping a strap around that section of the stack which is unsupported along its base surface so that the strap extends around the top and base surface and end faces of the stack and then securing the strap.

2. Apparatus for packaging a stack of tiles, each tile having projections on at least one face thereof, said apparatus comprising means for positioning a plurality of individual tiles one behind the other on one edge thereof to form an elongate stack having a top surface, a base surface and four side surfaces with opposite ends of said stack being formed by the faces of the end tiles of the stack, a packaging station having inlet and outlet ends, conveyor means for conveying the stack of tiles in the direction of the longitudinal central line of the stack through the packaging station and for supporting the stack of tiles along its base surface on one side only of the longitudinal central line of the stack leaving the base surface of the stack, on the opposite side of the longitudinal central line of the stack, unsupported, means for supporting the stack along another surface thereof, and means for wrapping and securing a strap around that section of the stack which is unsupported at its base surface during passage of the stack through the packaging station, whereby the integrity of the stack is maintained without interfering with the packaging operation in which the strap is passed around the top and bottom surfaces and end faces of the stack and the tiles can be packaged without stopping the passage of the stack through the packaging station.

3. Apparatus as claimed in claim 2, wherein the conveyor means is constituted by one, narrow, run of an existing conveyor on which the tiles are stacked and which conveys the stack of tiles to the packaging station.

4. Apparatus as claimed in claim 2, wherein the means for supporting the tile stack along another surface is positioned to be engaged by the top surface of the stack opposite the means for supporting the stack along its base surface.

5. Apparatus as claimed in claim 2, wherein the means for supporting the tile stack along another surface is positioned to be engaged by the side surface of the stack which is further from the unsupported base surface section of the stack.

6. Apparatus as claimed in claim 5, wherein the supporting means which is engaged by the said further side surface of the stack comprises a support which is reciprocable along the path of movement of the stack and which carries elongate means extending in the direction of said path of movement to be engaged by said further side surface.

7. Apparatus as claimed in claim 2, wherein said means for wrapping and securing the strap comprises a rectangular chute frame which receives a length of material from which the strap is formed and which depends from a support which is movable between the positions in which the chute frame encircles that section of the stack which is unsupported along its base surface and in which the chute frame is located to one side of the path of movement of the stack, said means for supporting the stack along another surface being located so as not to interfere with the movement of the shute frame.

8. Apparatus as claimed in claim 2, and including means for engaging a rear portion of the upper surface of the stack as it moves into a position for wrapping and securing a strap.

9. Apparatus as claimed in claim 2, including a delivery conveyor which is movable upwards into the path of movement of the stack at a position in which it receives a stack having a strap therearound and downwards into a position in which it is located out of the path of movement of the stack.

10. Apparatus as claimed in claim 2, including switching means arranged in the path of movement of the stack to initiate a wrapping and securing operation.

11. Apparatus as claimed in claim 2, wherein said means for positioning said tiles form the stack such that they occupy a sloping position in the stack.

12. Apparatus as claimed in claim 11, including switching means disposed in the path of movement of the stack for use in bringing the tiles to a substantially vertical position at said location.

13. Apparatus for packaging a stack of tiles, said stack having a top surface, a base surface and four side surfaces, each tile having projections on at least one face thereof, and arranged one behind the other on one edge thereof to form said stack, characterized in that the apparatus comprises first means for conveying the stack of tiles in the direction of the longitudinal central line of the stack and for supporting the stack of tiles along its base surface on one side only of the longitudinal central line of the stack leaving the base surface of the stack, on the opposite side of the longitudinal central line of the stack, unsupported, second means for supporting the stack of tiles along that side surface of the stack which is further from the supported base surface section of the stack, said second means comprising a support which is reciprocable along the path of movement of the stack and which carries elongate means extending in the direction of said path of movement to be engaged by said further side surface, and means for wrapping and securing a strap around that section of the stack which is unsupported along its base surface said wrapping and securing means comprising a rectangular chute frame which receives a length of material from which the strap is formed and which depends from a support which is movable between positions in which the chute frame encircles that section of the stack which is unsupported along its base surface and in which the chute frame is located to one side of the path of movement of the stack, said second means being located so as not to interfere with the movement of the chute frame.

* * * * *

UNITED STATES PATENT AND TRADEMARK OFFICE

CERTIFICATE OF CORRECTION

PATENT NO. : 4,292,785

DATED : October 6, 1981

INVENTOR(S) : Leslie G. Hammond

It is certified that error appears in the above—identified patent and that said Letters Patent is hereby corrected as shown below:

Claim 1, line 22, "surface" should be --surfaces--.

Signed and Sealed this

Ninth Day of February 1982

[SEAL]

*Attest:*

GERALD J. MOSSINGHOFF

*Attesting Officer*

*Commissioner of Patents and Trademarks*